US010570608B2

(12) United States Patent
Bertuca et al.

(10) Patent No.: US 10,570,608 B2
(45) Date of Patent: Feb. 25, 2020

(54) WALL LIFT MOUNT FIXTURE

(71) Applicants: Rocco R. Bertuca, Watervliet, MI (US); Regi Kurien, Kalamazoo, MI (US)

(72) Inventors: Rocco R. Bertuca, Watervliet, MI (US); Regi Kurien, Kalamazoo, MI (US)

( * ) Notice: Subject to any disclaimer, the term of this patent is extended or adjusted under 35 U.S.C. 154(b) by 0 days.

(21) Appl. No.: 16/010,616

(22) Filed: Jun. 18, 2018

(65) Prior Publication Data

US 2019/0382999 A1 Dec. 19, 2019

(51) Int. Cl.

| | |
|---|---|
| ***E04B 1/35*** | (2006.01) |
| ***E04G 21/16*** | (2006.01) |
| ***E04B 1/18*** | (2006.01) |
| ***E04B 1/41*** | (2006.01) |
| *E04B 1/38* | (2006.01) |

(52) U.S. Cl.

CPC ..... *E04B 1/355* (2013.01); *E04B 1/185* (2013.01); *E04B 1/40* (2013.01); *E04G 21/165* (2013.01); *E04G 21/168* (2013.01); *E04B 2001/405* (2013.01)

(58) Field of Classification Search

CPC . E04B 1/355; E04B 1/185; E04B 1/40; E04G 21/165; E04G 21/168

See application file for complete search history.

(56) References Cited

U.S. PATENT DOCUMENTS

| | | | | |
|---|---|---|---|---|
| 1,714,698 | A * | 5/1929 | Stoll | E04H 15/46 122/182.3 |
| 3,311,333 | A | 3/1967 | Galloway | |
| 3,671,738 | A | 6/1972 | Beachley | |
| 3,971,185 | A | 7/1976 | Hendrich | |
| 4,079,559 | A * | 3/1978 | Tenbrummeler | E02D 27/42 248/519 |
| 4,590,719 | A * | 5/1986 | McKibbin | E04H 12/34 212/179 |
| 4,662,146 | A * | 5/1987 | Parry | E02D 27/02 52/120 |
| 5,315,796 | A | 5/1994 | Gruhlke | |
| 5,375,384 | A | 12/1994 | Wolfson | |
| 5,568,909 | A | 10/1996 | Timko | |
| 5,634,301 | A * | 6/1997 | Koller | E04G 21/16 52/127.2 |
| 5,782,042 | A * | 7/1998 | Klein | E04H 12/187 52/116 |
| 5,833,430 | A * | 11/1998 | Reynolds | B66C 23/202 414/11 |

(Continued)

FOREIGN PATENT DOCUMENTS

DE 20 2014 008 316 U1 1/2015

OTHER PUBLICATIONS

Hamill Creek Timber Homes webpage; "Post and Beam Homes"; printed Mar. 27, 2018 (4 pages).

(Continued)

*Primary Examiner* — Paola Agudelo
(74) *Attorney, Agent, or Firm* — Flynn Thiel, P.C.

(57) ABSTRACT

A wall lift mount apparatus is provided for an easier and more efficient construction and erection of a wall in a building structure. Also provided is a method of constructing and erecting a wall using such a wall lift mount.

9 Claims, 8 Drawing Sheets

(56) References Cited

U.S. PATENT DOCUMENTS

| | | | | |
|---|---|---|---|---|
| 6,000,898 | A * | 12/1999 | Sharp | B66F 3/00 414/11 |
| 6,098,351 | A | 8/2000 | Mills | |
| 6,334,287 | B1 * | 1/2002 | Fick | E04B 1/355 16/226 |
| 6,513,290 | B2 | 2/2003 | Leek | |
| 6,886,296 | B1 | 5/2005 | John et al. | |
| 7,343,713 | B2 | 3/2008 | Knepp et al. | |
| 7,444,787 | B2 | 11/2008 | Cutforth | |
| 7,462,117 | B2 * | 12/2008 | White | A63B 63/083 473/481 |
| 7,513,083 | B2 | 4/2009 | Pryor et al. | |
| 8,317,454 | B1 * | 11/2012 | Parker | B28D 7/043 414/770 |
| 8,875,469 | B1 | 11/2014 | Keller, Sr. | |
| 9,085,441 | B2 * | 7/2015 | Mullins | E04G 21/168 |
| 2014/0115977 | A1 * | 5/2014 | Egan | E04H 12/345 52/116 |
| 2017/0175380 | A1 * | 6/2017 | Nehls | F16B 3/00 |

OTHER PUBLICATIONS

Timberhaven Log & Timber Homes webpage; "Post and Beam Construction: Introduction—Part 1"; pp. 1/5-4/5 printed Mar. 27, 2018 (4 pages).

Vermont Timber Works webpage; "Post and Beam Construction"; printed Mar. 27, 2018 (9 pages).

* cited by examiner

WALL LIFT MOUNT FIXTURE

BACKGROUND AND SUMMARY OF THE INVENTION

The present invention generally relates to construction of buildings and more specifically relates to construction of buildings using one or more posts.

Posts, typically made of wood, have been used for many years in the construction of buildings and have been used frequently in what is commonly referred to as post-and-beam construction. In many of these constructions, the posts are attached by an anchor to a concrete footing. Beams are then attached to the posts and other frame members may be attached to the posts and beams to create a wall.

This method of construction of walls requires that the wall be constructed vertically, and typically requires the use of one or more ladders or other elevation devices.

An embodiment of the present invention includes a method of raising a wall for a building structure comprising the steps of providing a building base, providing at least one wall lift mount including an outer frame member and a swing arm rotatably attached to the outer frame member, and attaching the at least one wall lift mount to the building base. A post is attached to each wall lift mount, a wall is constructed on the building base which includes each of the posts attached to a wall lift mount, and the wall is lifted to a vertical position in part by rotating the swing arm upwardly with respect to the outer frame member. Each post is then attached to the outer frame member of its respective wall lift mount.

Another aspect of the present invention is a wall lift mount which comprises an outer frame member and a swing arm rotatably connected to the outer frame member. The outer frame member has a rear wall and at least one side wall attached to the rear wall, with each side wall having a plurality of apertures therein each sized to receive a fastener. The outer frame member also includes a first end and a second end. The swing arm is rotatably connected to the outer frame member about a pivot axis adjacent the first end of the outer frame member, and the swing arm has a plurality of apertures therein each sized and shaped to receive a fastener for attachment of a wall post thereto. The swing arm is positioned relative to the outer frame member such that a post attached to the swing arm may be moved to a position adjacent the side wall of the outer frame member for attachment thereto by use of fasteners through the apertures.

Another embodiment of the present invention is a method of constructing a building which comprises the steps of providing a building site, providing at least one outside frame form at the building site, providing a wall lift mount having an outer base member and a separated inner swing arm member, attaching the outer base member of the wall lift mount to the at least one outside frame form, pouring a concrete footing adjacent the wall lift mount, pouring a concrete floor a portion of which is adjacent or abuts the wall lift mounts, pivotally attaching the inner swing arm member to the outer base member of the wall lift mount, securely attaching a post to the inner swing arm member, forming a wall which includes the post, rotating the inner swing arm member toward the outer base member such that the wall is erected, and securing the post to the outer base member.

Other advantages, objects and/or purposes of the invention will be apparent to persons familiar with constructions of this general type upon reading the following specification and inspecting the accompanying drawings.

BRIEF DESCRIPTION OF THE DRAWINGS FIGURES

DETAILED DESCRIPTION OF THE PREFERRED EMBODIMENT

For purposes of description herein, it is to be understood that the invention may assume various alternative orientations, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
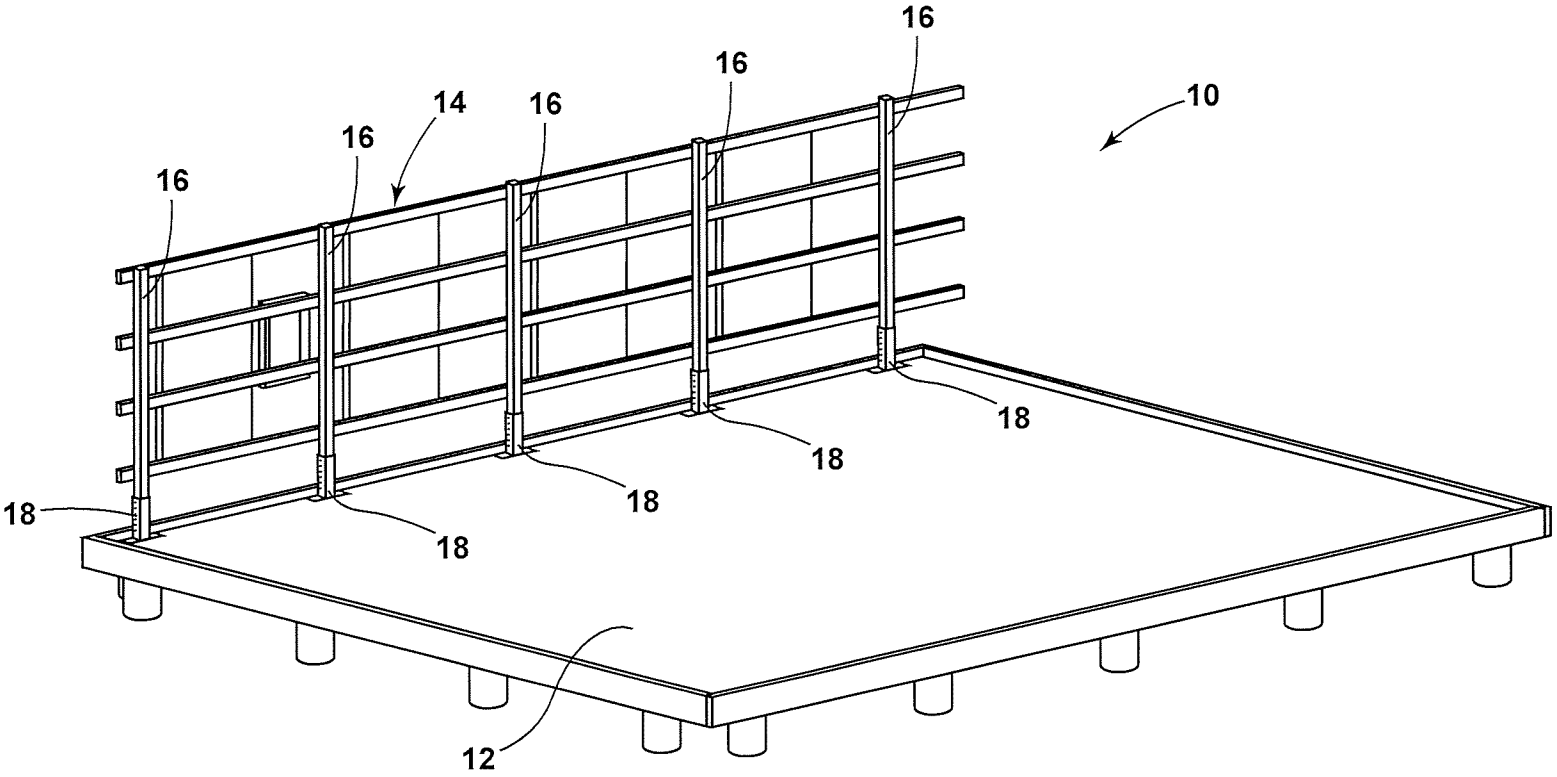
FIG. 1 is a perspective view of a base and erected wall of a building structure incorporating aspects of the present invention.

Referring to FIG. 1 there is illustrated a portion of a building 10 that generally includes a base or foundation 12 and a wall 14. The wall 14 is attached to the base 12 by the use of a plurality of posts 16, which are spaced, preferably evenly, from one another along a length of the base 12. In this embodiment, the posts 16 are attached to the base by using wall lift mounts 18.

Figure 2:
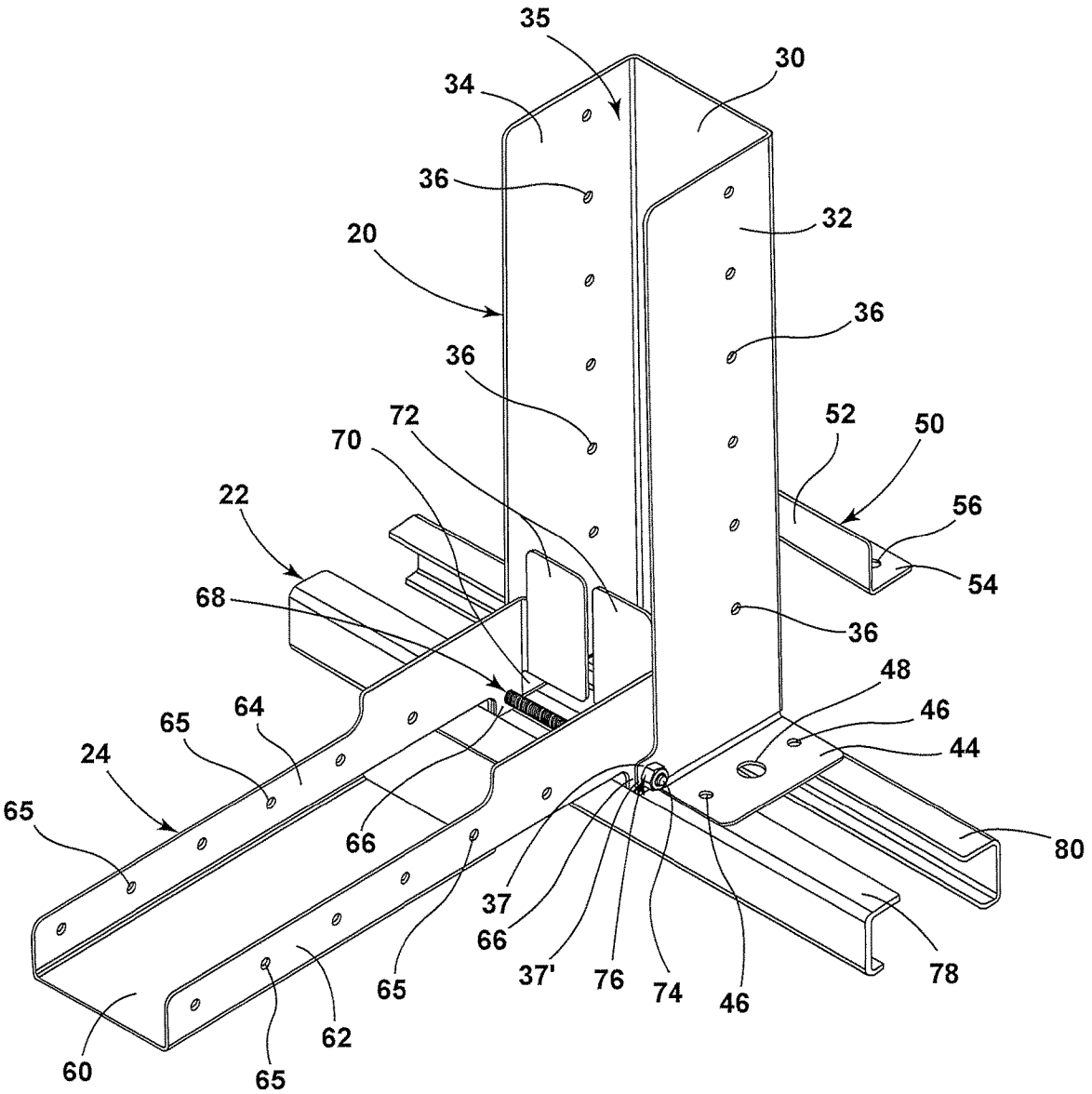
FIG. 2 is a perspective view of a wall lift mount which is an embodiment of the present invention.
Figure 3:
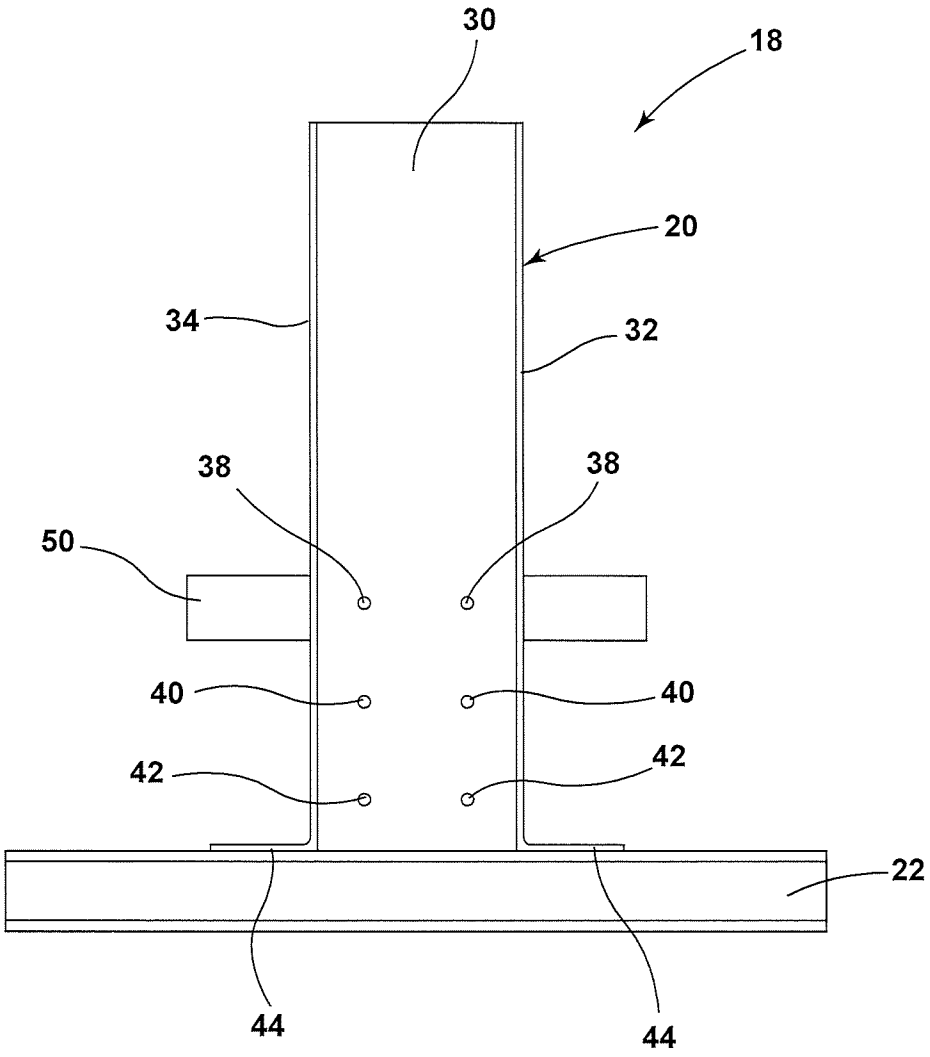
FIG. 3 is an elevational end view of a portion of the wall lift mount of FIG. 2, including an outer frame member, a support bracket for engagement with an outside building form, and a base angle mount.

The wall lift mount 18 is shown in more detail in FIGS. 2-3. The wall lift mount 18 generally includes an outside frame member 20, a base angle mount 22, and a swing arm 24. The outside frame member 20 includes a rear wall 30, a first side wall 32 which is attached to the rear wall 30, and second side wall 34 which is also attached to the rear wall 30, preferably in a substantially perpendicular fashion. Each of the side walls 32, 34 has a plurality of linearly disposed, spaced apertures 36 which are located along a longitudinal axis of the sidewalls 32, 34. The apertures 36 are each sized to receive a fastener such as a nail or screw for attachment of the outside frame member 20 to a post.

The size and shape of the rear wall 30 and side walls 32, 34 result in a space 35 for receiving a post, which will be discussed in detail below. The rear wall 30 also includes a plurality of apertures, as shown in FIG. 3. A top pair of apertures 38 are sized and positioned for welding the rear wall 30 to a support bracket 50. Two other pairs of apertures 40, 42 are provided to assist in attachment of the outside frame member 20 to an outer building frame form by use of fasteners.

Each of the sidewalls 32, 34 includes a small, lower foot 37. When the wall lift mount is in use, each foot extends toward the interior of what is or will be the building 10. Each foot 37 has a small aperture 37' therein for receiving a rod or bolt. The apertures 37' are aligned with respect to one another along a transverse axis. Each of the feet 37 extends in a direction substantially parallel with the longitudinal axis of the swing arm 24 in the position as the swing arm 24 is shown in FIG. 2.

Extending outwardly from the bottom edge of the sidewalls 32, 34 of the outside frame member 20 are attachment flanges 44. The attachment flanges 44 extend substantially perpendicularly to the longitudinal axis of the side walls 32, 34. Each of the attachment flanges 44 includes a pair of outer apertures 46 which can be used to attach the outside frame member 20 to both parts of the base angle mount 22. Each attachment flange 44 also includes a larger, central hole 48.

The support bracket 50 is generally an L-shaped bracket that is preferably somewhat wider than the width of the rear wall 30. The support bracket 50 includes an upright member 52 and a horizontal member 54 which is attached to the upright member 52. The upright member 52 and horizontal member 54 are at approximately 90 degrees with respect to one another. The upright member 52 is attached to the rear wall 30 of the outside frame member 20, preferably by welding using the apertures 38. The horizontal member 54 preferably has a plurality, such as two, apertures 56 therein. Most preferably, the apertures 56 are located adjacent the respective longitudinal ends of the support bracket 50 and are sized and shaped to receive fasteners for attachment of the support bracket 50 to a building form member.

The swing arm 24 includes a longitudinal base member 60 which preferably extends less than the entire length of the swing arm 24. Attached to the base member 60 are a first side wall 62 and second side wall 64. Each of the side walls 62, 64 is in a plane that is substantially perpendicular to the plane in which the base member 60 resides. The side walls 62, 64 are longer than the base member 60 and extend nearly the entire length of the swing arm 24. At one end of each sidewall 62, 64 is an extending foot 66. There is an aperture 68 in each of the feet 66. The apertures 68 are sized and shaped similarly to the apertures 37' and are sized and shaped to receive a rod or bolt.

The side walls 62, 64 of the swing arm 24 each preferably has a plurality of aligned apertures 65. The apertures 65 are preferably spaced from one another and substantially centrally located within the width of the sidewalls 62, 64. Six apertures 65 are shown in each of the sidewalls 62, 64, but any number of apertures may be used that is adequate for attachment of the swing arm 24 to a post. The apertures 65 are sized and shaped to receive fasteners for attachment to such a post.

Extending from the end of the sidewalls 62, 64 are extension members 70. The extension members 70 are preferably permanently attached to the end of the sidewalls 62, 64 and are rectangular in shape, but may be any shape that is appropriate for attachment of tabs thereto. The extension members 70 are preferably in the same plane as the base member 60 or in a parallel plane, but may be in any plane that is useful and appropriate. The extension members 70 preferably extend at least partially into the space 35 defined by the walls of the outside frame member 20 when the swing arm 24 is attached to and positioned with respect to the outside frame member 20 as shown in FIG. 2.

Extending from each of the extension members 70 is a tab 72. The tabs 72 are preferably adjacent one another, in the same plane as one another, and are in a plane substantially perpendicular to the plane of the base member 60 of the swing arm 24. The tabs 72 are each preferably permanently affixed to an extension member 70 such as by welding. The tabs 72 are sized, shaped, and affixed appropriately to an extension member 70 so as to engage and retain a post in place.

The swing arm 24 may be pivotally attached to the outside frame member 20 by placing the sidewalls 62, 64 in the inner space 35, adjacent sidewalls 32, 34, respectively. The foot apertures 68 are aligned with the foot apertures 37' and a rod 74 is inserted through the foot apertures 37', 68 to pivotally attach the components. The rod 74 may take the form of a bolt, such as a hex head bolt, and may be secured by the use of a lock nut 76. The lock nut 76 is tightened to secure the swing arm 24 to the outside frame member 20, while allowing the swing arm 24 to pivot relative to the outside frame member 20.

The base angle mount 22 is preferably comprised of two members 78, 80 which are each generally C-shaped and mirror images of one another. Each member 78, 80 of the base angle mount 22 has a wider top portion relative to the bottom portion, with the top portion being attached such as by welding to the attachment flanges 44. The members 78, 80 are preferably spaced from one another to allow adequate engagement with a concrete footing, as discussed in more detail below.

Figure 4B:
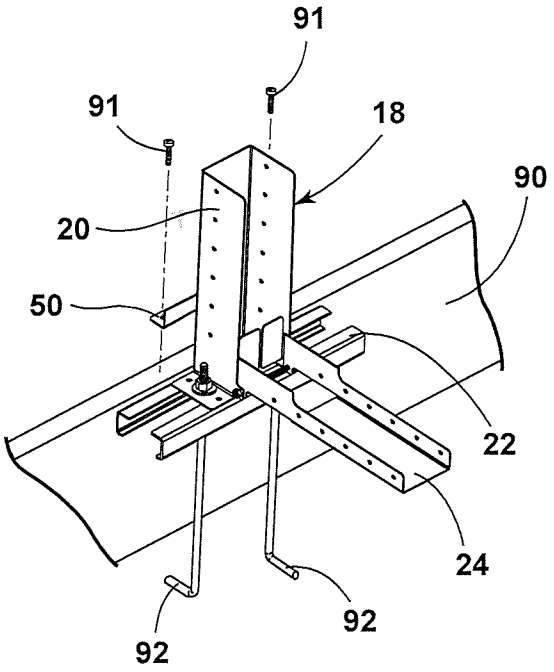
FIG. 4B is an enlarged portion of FIG. 4A indicated as IVB in FIG. 4A, and is a perspective view of the wall lift mount of FIG. 2 attached to an outside building form.
Figure 4A:
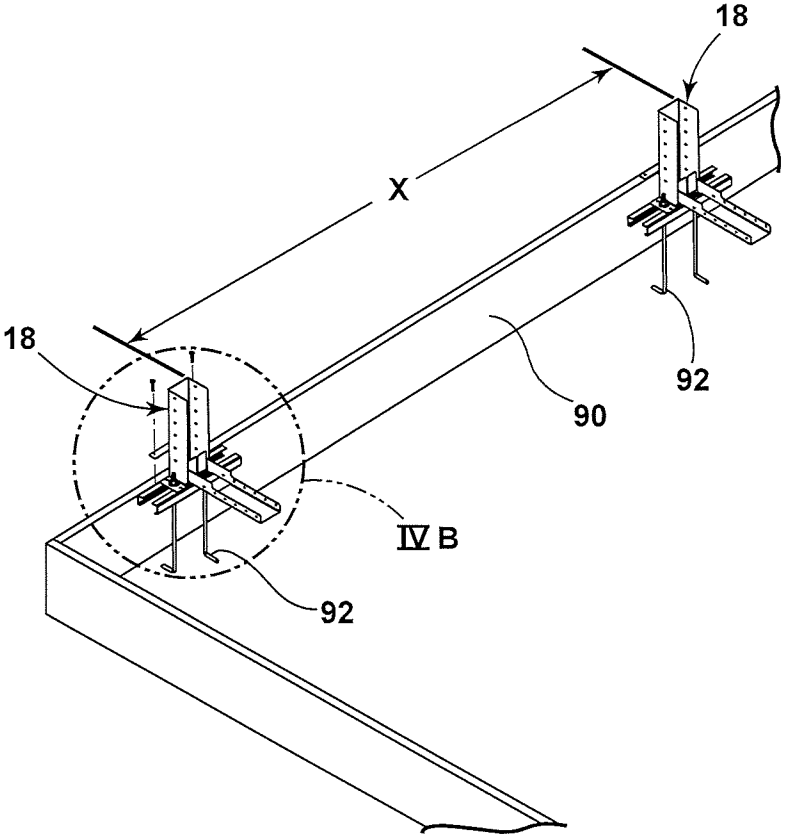
FIG. 4A is a perspective view of an outside building form with two of the wall lift mounts of FIG. 2 attached thereto.

In use, a plurality of wall lift mounts 18 are attached to an outside building form 90 as shown in FIGS. 4A-4B. The wall lift mounts 18 are spaced from one another a distance X which is any adequate distance for forming a wall, but in one embodiment is about 96 inches. The wall lift mounts 18 are preferably attached to the outer forms 90 by use of fasteners 91 through the support bracket apertures 56 and into the top of the outside form. Additional fasteners may be inserted into and through the apertures 40, 42 for attachment of the wall lift mount to the outer form 90. Anchor bolts 92 are attached to each wall lift mount 18 through the central hole 48 in each attachment flange 44. The anchor bolts 92 are any suitable anchor bolts for anchoring the wall lift mount 18 to a cement footing, but as an example may be half-inch diameter by sixteen inches length standard steel bent anchor bolts.

Figure 5A:
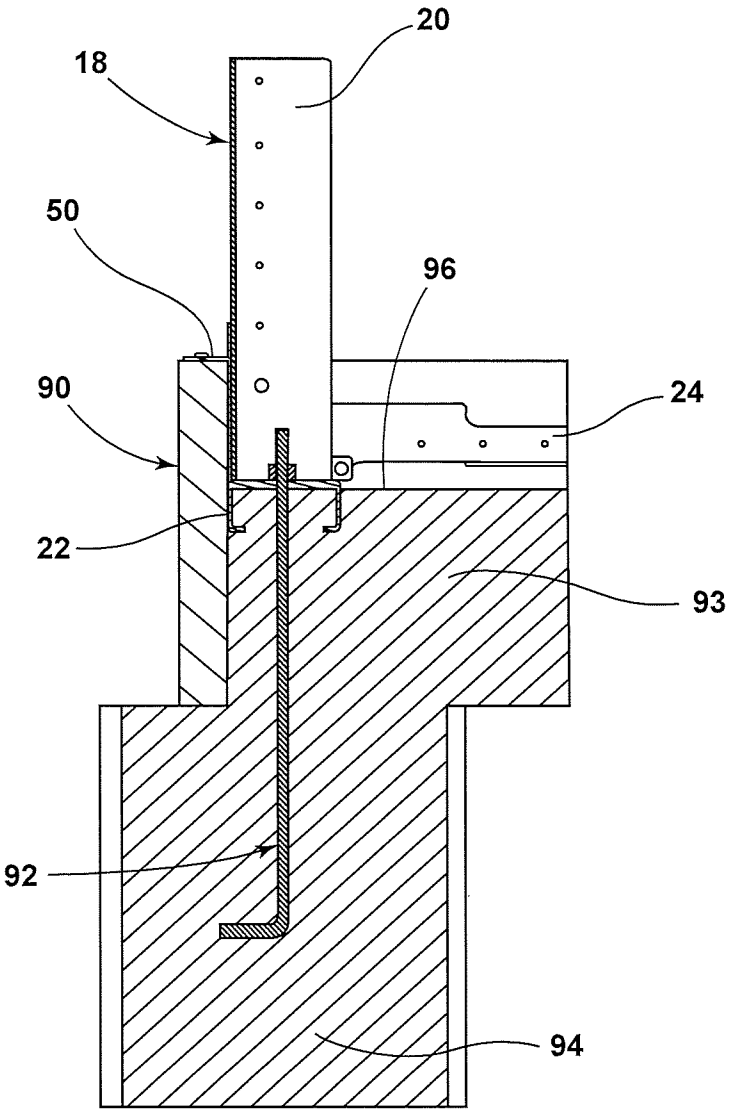
FIG. 5A is a side elevational view of the wall lift mount of FIG. 2 attached to an outside building form and anchored to a concrete footing.
Figure 5B:
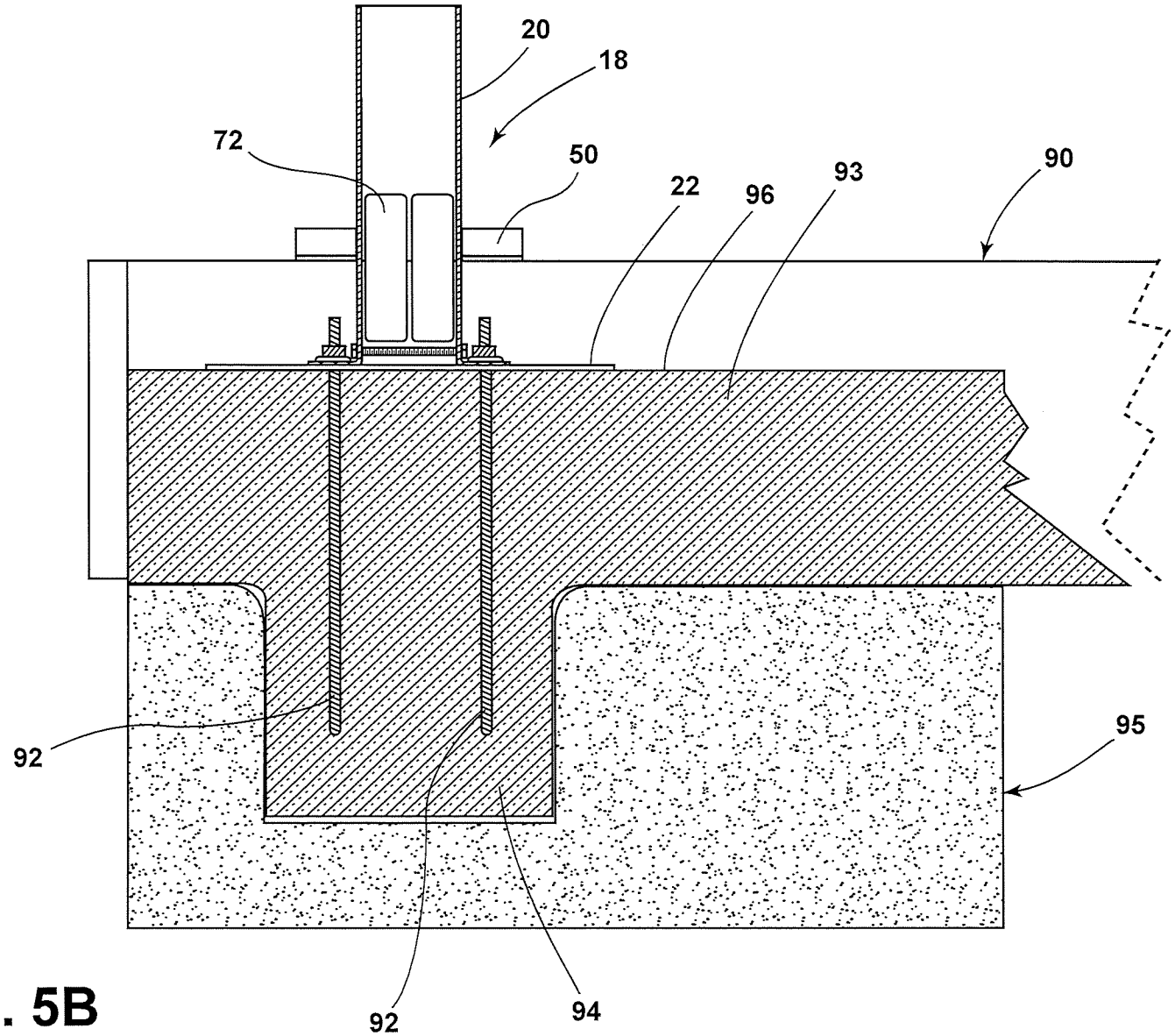
FIG. 5B is a front elevational view of the attached and anchored wall lift mount of FIG. 5A.

Once all of the wall lift mounts 18 are attached to the outside forms 90 and the anchor bolts 92 are in place, a cement footing 94 near each wall lift mount 18 is poured, as shown in FIGS. 5A-5B. The cement footings 94 are each surrounded by subgrade material 95. The cement footing is poured to encompass the bottom portion of the anchor bolts 92. A cement base 93 is then poured on top of the cement footings 94 and subgrade 95. The cement base 93 encompasses nearly the remainder of each of the anchor bolts 92 and virtually all of each of the base angle mounts 22. The cement base 93 has a top surface 96, part of which abuts or is adjacent the bottom surface of the attachment flanges 44 and the bottom edges of the sidewalls 32, 34.

Figure 6B:
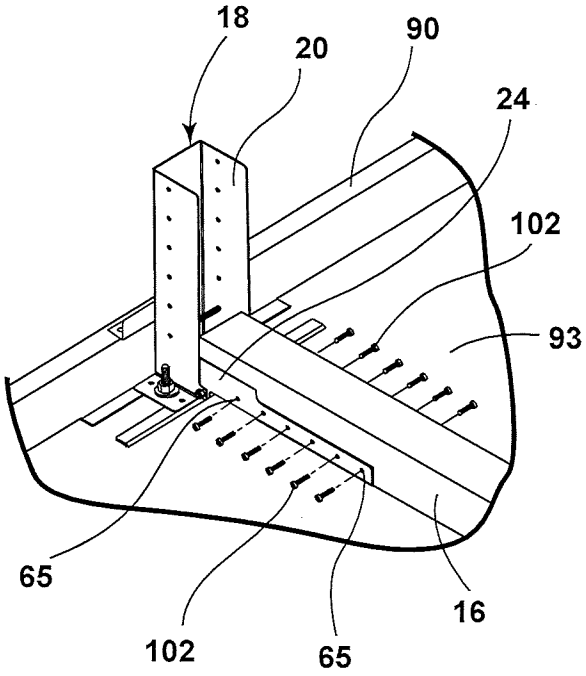
FIG. 6B is an enlarged portion of FIG. 6A indicated as VIB in FIG. 6A, and is a perspective view of one of a wall lift mount and posts.
Figure 6A:
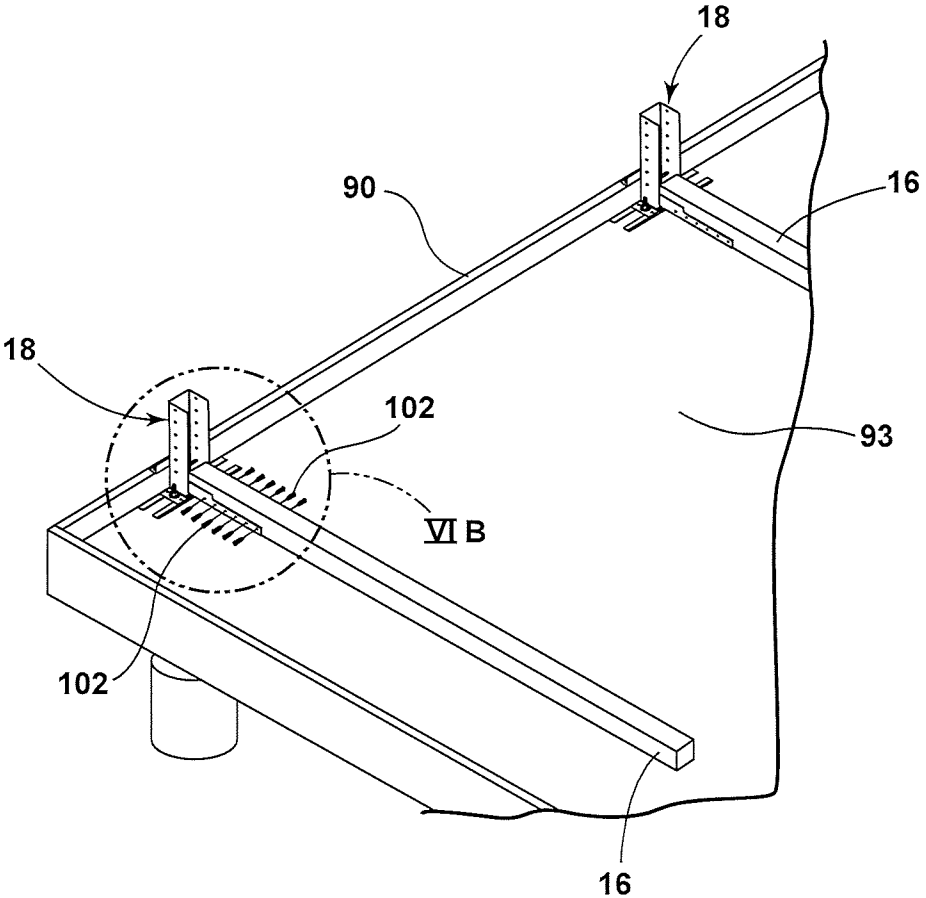
FIG. 6A is a perspective view of the outside building form and wall lift mounts of FIG. 4A with a post being attached to the swing arm of the wall lift mount.

Once the cement base 94 is level and set, which typically will be in the form of a slab, a post may be attached to each of the wall lift mounts 18. If the swing arms 24 are not already attached to the outside frame members 20, the swing arms 24 are attached by use of rods 74 and lock nuts 76. As shown in FIGS. 6A-6B, the post 16 is then attached to the swing arm 24. The post 16 is placed in the interior of the swing arm 24, between the side walls 62, 64 and on top of the base member 60. The post 16 can be placed on the top surface of the cement base 93 and is slid such that the bottom of the post abuts each of the tabs 72. Once in position, the post 16 is then secured to the swing arm 24 by the use of fasteners 102, such as screws or nails. The fasteners 102 are each placed into and through an aperture 65 and into the post 16 for securing the post 16 to the swing arm 24.

Figure 7:
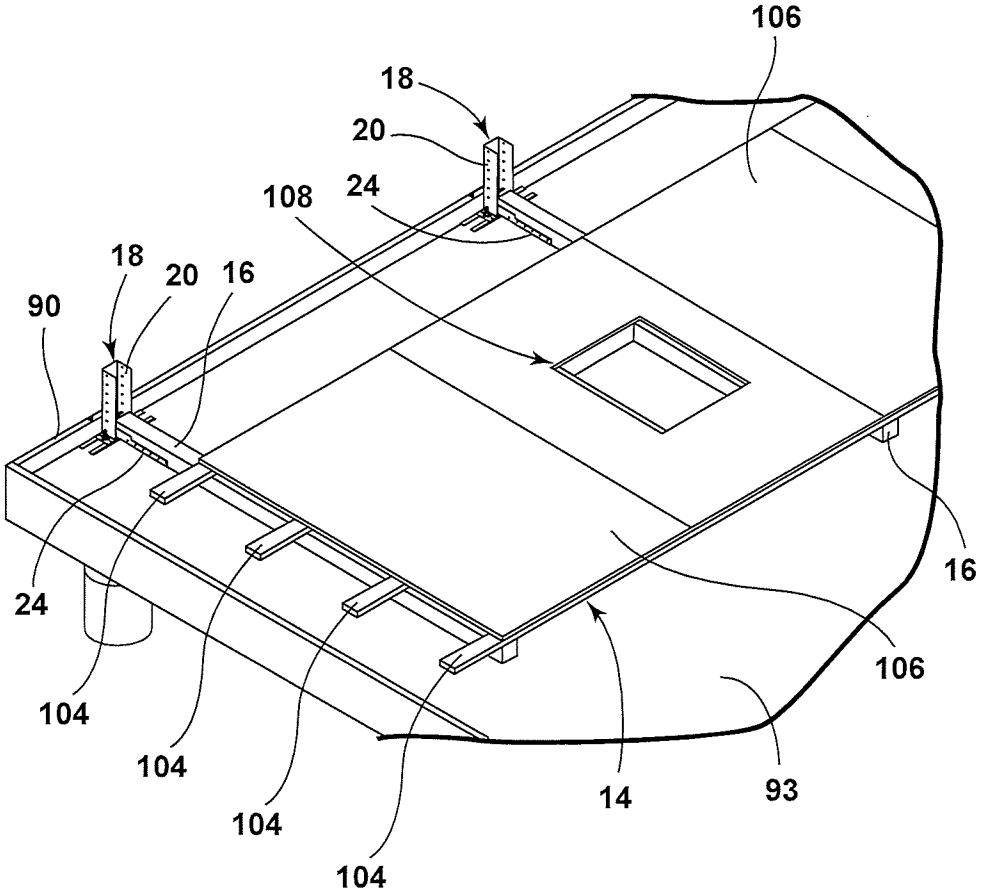
FIG. 7 is a perspective view of a constructed wall using the posts shown in FIG. 6A.

After all of the posts 16 are attached to their respective swing arms 24 along a side of the building, a wall, such as the wall 14 shown in FIG. 1, can be formed incorporating the posts 16 as well as beams 104 and sheets 106 using standard fastening techniques (see FIG. 7). Openings 108, such as for window or doors, may be cut into one or more of the sheets 106. The entire wall 14 is preferably formed in a horizontal fashion with the posts 16 lying on the cement base 93. However, it is contemplated that only a portion of the wall may be completed in this horizontal fashion. Once the wall 14 or desired portion of the wall 14 is constructed in the horizontal fashion with the posts 16 lying on the cement floor 93, the wall 14 can then be erected.

Figure 8:
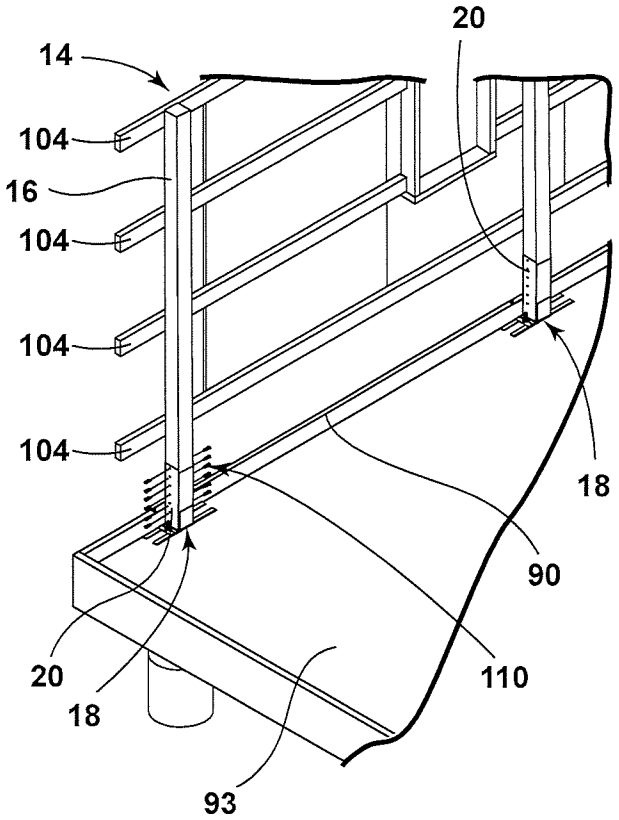
FIG. 8 is a perspective view of an erected wall and showing fasteners for attachment of the posts of FIG. 6A to an outer frame member of the wall lift mounts.

The wall 14 is erected by pushing the top of the wall upwardly which causes each of the swing arms 24 (connected to a post 16) to rotate, about the axis of its respective rod 74, with respect to the outside frame member 20. Once erect, the backside of each post 16 is received in the space 35 of the outside frame member and abuts the rear wall 30 of the respective outside frame member 20. As shown in FIG. 8, each post 16 may then be attached to the outside frame member 20 by use of fasteners 110, such as screws or nails.

The remainder of the walls of the building can be constructed and erected using this method. The rest of the building can be manufactured according to common building techniques.

The above-described apparatus and method result in a procedure for manufacturing and erecting walls that is easier and less dangerous than traditional wall erection. This is especially true for post-and-beam type building structures, but the same or similar apparatus and methods may be used for other types of building structures as well.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A wall lift mount apparatus comprising:

an outer frame member having at least one wall having an outer frame member aperture therein sized to receive a fastener, the outer frame member having a first end and a second end; and a swing arm rotatably connected to the outer frame member about a pivot axis adjacent the at least one wall, the swing arm having a swing arm aperture therein sized and shaped to receive a fastener for attachment of a post thereto, the swing arm configured and positioned to lift the post to a position adjacent the wall such that the post extends out of the second end of the outer frame member and for attachment of the post to the wall lift mount by use of a fastener through at least one of the outer frame member aperture and the swing arm aperture.

2. The wall lift mount apparatus of claim 1, and further including a tab for engagement with the end edge of the post.

3. The wall lift mount apparatus of claim 2, wherein the tab is attached to the swing arm.

4. The wall lift mount apparatus of claim 3, wherein the swing arm has a swing arm longitudinal axis and the tab has a tab longitudinal axis, the tab longitudinal axis being substantially perpendicular to the swing arm longitudinal axis.

5. The wall lift mount apparatus of claim 4, and further including a support bracket for engagement with an outside building form.

6. The wall lift mount apparatus of claim 1, and further including a support bracket for engagement with an outside building form.

7. The wall lift mount apparatus of claim 6, and further including a base angle mount attached to the outer frame member and configured to attach the wall lift mount to a concrete slab.

8. The wall lift mount apparatus of claim 1, wherein the outer frame member comprises at least two walls and the swing arm comprises at least two walls.

9. A building comprising:

a base; and a wall lift mount comprising:

an outer frame member having at least one wall having an outer frame member aperture therein sized to receive a fastener, the outer frame member having a first end and a second end; and a swing arm rotatably connected to the outer frame member about a pivot axis adjacent the at least one wall, the swing arm having a swing arm aperture therein sized and shaped to receive a fastener for attachment of a post thereto, the swing arm positioned to lift the post to a position adjacent the wall for attachment thereto by use of a fastener through at least one of the outer frame member aperture and the swing arm aperture, the wall lift mount permanently attached to the base.

* * * * *